US007964045B1

(12) United States Patent
Stec, III et al.

(10) Patent No.: US 7,964,045 B1
(45) Date of Patent: Jun. 21, 2011

(54) METHOD FOR PRODUCING AND USING HIGH EXPLOSIVE MATERIAL

(75) Inventors: Daniel Stec, III, Long Valley, NJ (US); Gartung Cheng, Edison, NJ (US); Brian E. Fuchs, Hackettstown, NJ (US); Neha Mehta, Randolph, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/466,598

(22) Filed: May 15, 2009

Related U.S. Application Data

(62) Division of application No. 10/464,787, filed on Jun. 11, 2003.

(51) Int. Cl.
*D03D 23/00* (2006.01)

(52) U.S. Cl. ..... 149/109.6

(58) Field of Classification Search ..... 149/109.6, 149/19.9; 102/293
See application file for complete search history.

(56) References Cited

U.S. PATENT DOCUMENTS

| | | | | |
|---|---|---|---|---|
| 2,995,430 | A * | 8/1961 | Scharf | 149/19.9 |
| 4,550,681 | A * | 11/1985 | Zimmer et al. | 118/410 |
| 5,046,425 | A * | 9/1991 | Gibbons et al. | 102/293 |
| 6,170,399 | B1 * | 1/2001 | Nielson et al. | 102/336 |

* cited by examiner

*Primary Examiner* — Aileen Felton
(74) *Attorney, Agent, or Firm* — Henry J. Goldfine

(57) ABSTRACT

High explosive coatings and inks suitable for use in micro-electronic initiators for micro-electro-mechanical mechanisms used as safe and arm devices, are prepared from coating compositions of crystalline energetic materials and applied using various methods. These methods include wiping and spraying, as well as, pressure applications using a syringe or the like, and application of thick film ink to write specified patterns on a selected surface. A volatile mobile phase may be added to the coating composition to partially dissolve the energetic material so that, upon evaporation of the mobile phase, the energetic material precipitates and adheres to the selected surface.

14 Claims, 4 Drawing Sheets

METHOD FOR PRODUCING AND USING HIGH EXPLOSIVE MATERIAL

CROSS-REFERENCES TO RELATED APPLICATIONS

This application is a divisional of our prior application Ser. No. 10/464,787, filed Jun. 11, 2003, which is currently co-pending, and which is hereby incorporated by reference.

U.S. GOVERNMENT INTEREST

The inventions described herein may be manufactured, used and licensed by or for the U.S. Government for U.S. Government purposes.

BACKGROUND OF THE INVENTION

1. Field of the Invention

The present invention relates to methods for preparing and using energetic coatings and inks (generically referred to hereinafter as coatings) containing crystalline high explosive materials.

2. Related Art

The basic standard methods for loading energetic or explosive materials into munitions are press-loading, and cast loading (whether using melt-cast or cast-cure techniques). With the relatively recent emergence of the production of smart weapon systems that are lighter and smaller and have greater lethality and survivability, the need exists for smaller, reliable Safe and Arm (S&A) devices for activating the explosive train of the explosive device. The challenges in producing Micro-Energetic Initiators (MEI) for Micro Electro-mechanical Mechanisms (MEMS) as safe and arm devices, involve the need to introduce the energetic materials into extremely small volumes and to have the energetic materials function properly after such introduction. MEIs for safe and arm devices will necessarily be smaller in size and weight than traditional fuzing devices, and will permit a larger loading of the energetic fill of the end item, thereby resulting in increased lethality. The standard loading methods mentioned above cannot be used to load the very small (microliter) volumes contained in these devices.

Considering the latter point in more detail, as indicated previously, the standard methods for loading an energetic fill into a munition are press-loading and cast-loading. With respect to the former, delivering the material to the fixture, followed by consolidation thereof by pressing, presents difficulties because of the very small required volume of the solids. Further, because of the delicateness of the materials of construction of the critical fixture, press loading of the energetic fill into the fixture is not a viable option. One potential approach would be to prepare a pellet of the energetic material externally of the fixture, and then load the pellet into the fixture. To complete the process, in order to maintain the pellet in place, some kind of adhesive would have to be applied to the pellet, e.g., on the side thereof, or the wall of the fixture. It will be appreciated that such a process would be cumbersome and relatively costly.

As was also mentioned previously, casting of an energetic fill into a fixture can be done either by melt casting or cast curing. Melt casting basically entails heating a substance to a temperature above its melt point, adding any needed ancillary materials to the melt, pouring the mixture into the volume to be filled, and allowing the fill to solidify in place. Among other problems with this approach, because of the very small delivery volumes involved in producing MEIs for safe and arm devices, heat loss to the ambient environment would be a problem and, in this regard, could cause the energetic material to solidify before being emplaced.

Cast curing basically entails mixing the substance to be cast in a liquid polymer mixed with a cross-linking reagent. The resultant cast mixture has a finite "pot life" after which the viscosity of the mixture increases because of the chemical crosslinking process. This change in rheological properties may cause difficulty in the delivery into the fixture of energetic material prepared in this way.

Extrusion of energetic material has been carried out to produce propellant grains, to pre-consolidate some high explosive formulations which are then pressed into final form and to produce sheet explosives.

There are, of course, a number of state-of-the-art delivery devices for the delivery of small volumes of materials including ink jet printing. The latter is a mature technology that can be used to accurately deliver small volumes of material. However, the present technology is unsuitable for delivering energetic materials for two reasons. First, most inks used for ink jet printing are dye-based, i.e., the colorant dye is dissolved in the fluid medium, and although there are pigment-based ink jet inks available, wherein the colorant is an undissolved crystalline material, the undissolved solids are of sub-micron size. Important secondary high explosives such as CL-20 (epsilon HNIW) are not presently available in sub-micron particle size. Further, in an ink jet printer, the ink is typically delivered from the print head by a piezoelectric discharge that ejects droplets of ink at elevated pressure and temperature onto the printing substrate; the combination of an electric discharge and high temperature/pressure may be a safety hazard when attempting to deliver energetic materials using ink jet printers.

SUMMARY OF THE INVENTION

As indicated above, the present invention is concerned with the use of crystalline high explosive materials in MEMS/MEI safe and arm devices. As will appear, the methods of the invention serve to overcome the problems discussed above in connection with loading crystalline high explosive into small volumes.

Before considering the invention in more detail, a further loading method of particular interest here is one that is used exclusively for primary explosives. As will be understood by those familiar with this field, a distinction is drawn between primary explosives (e.g., lead styphnate and the like) which are highly sensitive explosives that may detonate in response to small "insult" and secondary explosives which require a strong shock to detonate, a shock with is typically provide by another explosive. Primary explosives in small quantities have been ground up wet and added to a slurry which is, e.g. deposited on a bridgewire. With secondary explosives, the typical application are large volume applications such as munitions wherein the secondary explosive is the main energetic fill, and wherein, maximum power or performance is desired. An important figure of merit in determining performance is the % Theoretical Maximum Density (TMD). The aim is that this percentage should be as high as possible because cracks, porosity and the like reduce the power/performance of the secondary explosive and also, undesirably, increase the sensitivity of the explosive. As a result, secondary explosive formulations are normally cast or pressed into final or near-final shape as described above because if such formulations were to be loaded as a slurry into a large volume mention, the drying time (for evaporation of the slurry medium) would be excessively long and the volatile medium would have to diffuse through dried material potentially causing defects in the fill such as porosity, voids, cracks, entrapped slurry medium and the like. These defects would result in safety and performance problems and thus, slurry loading has not been used for secondary explosives.

The present invention is based, in part, on the inventive appreciation that, despite the serious potential problems with slurry loading of secondary explosives, an approach employing coating compositions containing secondary crystalline explosives can be used to great advantage. The surprising finding has been that with such an approach, even though the resulting coat or film has a lower % TMD, than if pressed or cast and thus has an attendant increase in the number of defects, the evaporation takes place in a straightforward manner, the resultant coating has the physical strength and integrity essential for proper functioning of the loaded item, and, quite unexpectedly, the resultant increase in defects does not have a deleterious effect on the energetic performance in the MEMS scale. In fact, in the latter regard, despite the density decrease, the energetic performance of the coating has been found to be very much better than would normally be expected and even better than conventional approaches.

In accordance with the invention there is provided an explosive coating on a receiving surface, the method comprising the steps of: preparing a coating composition suitable for coating a receiving surface including a step of incorporating a crystalline energetic material into the coating composition; and applying the coating composition as a coating on the receiving surface.

In one preferred embodiment, applying of the coating composition comprises wiping the coating composition on the receiving surface. Preferably, the wiping of the coating composition comprises using a brush or roller to effect the wiping.

In another important embodiment, applying of the coating composition comprises applying the coating composition as a thick film ink so as to produce, by writing with the ink, at least one predetermined pattern on the receiving surface. Advantageously, the thick ink is used to produce at least one explosive logic circuit.

In yet another important embodiment, applying of the coating composition comprises using pressure to dispense the coating composition from a container through an orifice in the container. In one implementation, the coating composition is dispensed by using a pipette. In another, the coating composition is dispensed by using a syringe in yet another, the coating composition is dispensed by a pump.

In a further important embodiment, applying of the coating composition comprises spraying of the coating composition onto the receiving surface.

In an important application, the coating composition is used to prepare a self-destruct circuit on the receiving surface.

In another important application, the coating composition is used to prepare a demolition device.

In a further important application, the receiving surface is part of a small volume loading hole and the coating composition is used to provide loading of the loading hole.

In another important application, the coating composition is used to provide an explosive initiation train on the receiving surface.

In further important application, the coating composition is used to produce a multi-part explosive initiation system.

In one preferred embodiment, the coating composition is prepared as a slurry in a volatile mobile phase. In one implementation, the volatile mobile phase is aqueous, while in another, the volatile mobile phase is organic.

Preferably, the coating composition is prepared as a slurry including a volatile mobile phase which partially dissolves the energetic material to form a liquid, and wherein when the coating is applied, the liquid evaporates and the dissolved energetic material precipitates and adheres to the receiving surface.

Advantageously, a polymeric binder is incorporated in the coating composition so as to act as adhesive between the crystals of the crystalline energetic material and the receiving surface. The binder is preferably incorporated in an amount between 0.01 and 10 weight percent with respect to the crystalline energetic material.

Preferably, the crystalline energetic material is incorporated as solid fill particles having a particle size of no greater than 25 microns. Advantageously, the solid particles are prepared by comminution of raw energetic material. Preferably, the coating is prepared as an ink, comminution is carried out by ball milling and a small volume of mobile phase and a binder component are added prior to ball milling.

In another preferred embodiment, the coating composition is prepared by adding a solid form of the energetic material in a plurality of separate portions, the composition is mixed until the one of the separate portions that has been added is completely incorporated, and the method continues until all of the solid energetic material is mixed in and a homogeneous suspension is obtained.

Advantageously, the solid form energetic material is added as a dry solid fill or a mill base.

Preferably, the solid form energetic material is added as a mill base containing the energetic material.

Preferably, a binder system is added to the coating composition which is selected from the group polyvinyl alcohol, polyvinyl alcohol/polyvinyl ester copolymers, polyacrylates, casein, polyvinyl alcohol/polyvinyl pyrrolidone copolymers, polyvinyl pyrrolidone, substituted polyvinyl pyrrolidone, ethylene-vinyl alcohol/acetate terpolymers, polyurethanes, styrene-maleic anhydride copolymers, and styrene-acrylic copolymers, epichlorohydrin-based polymers and oxetane-based polymers. Preferably, the epichlorohydrin-based polymers include the energetic polymers GAP and polyGLYN. Advantageously, the oxetane-based polymers include polyBAMO, polyAMMO, BAMO-AMMO copolymers, and polyNIMMO.

Preferably, the crystalline energetic material is selected from the group consisting of CL-20, HMX, RDX, TNAZ, PETN, FINS, and all crystalline polymorphs thereof.

Further features and advantages of the present invention will be set forth in, or apparently from, the detailed description of preferred embodiments thereof which follows.

DESCRIPTION OF THE PREFERRED EMBODIMENTS

Figure 1:
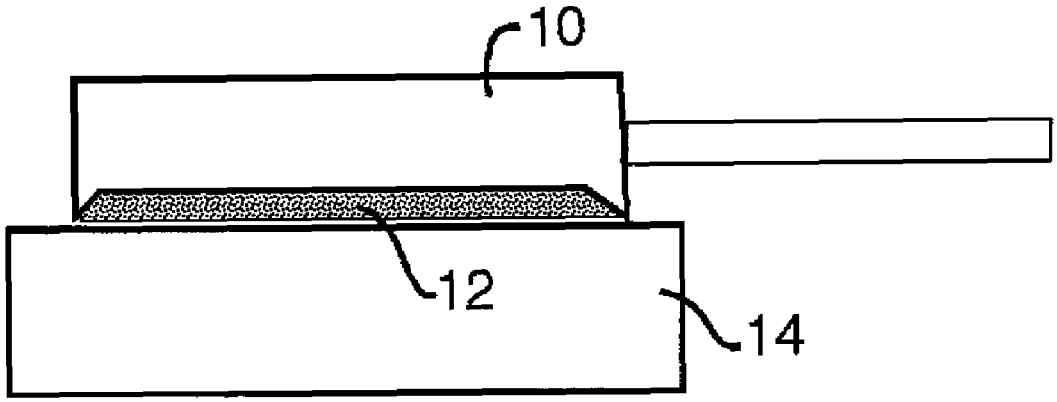
FIG. 1 is a schematic side elevation view, partially in section, of an energetic coating delivery system in accordance with a first embodiment of the invention.

As indicated above, the present invention is particularly concerned with MEMS-based safety and arming devices. It will be understood that a MEMS (mechanical) S&A is not a "sensor" device per se, but rather a device wherein the components thereof intrinsically combine both "sense" and "actuate" functions in a single unpowered chip. Although the invention is obviously not limited to use with a particular device, an example of such a device is disclosed in U.S. Pat. No. 6,167,809, which is hereby incorporated by reference. Devices of this kind can include a transfer charge, as well as, conventional primary explosives upstream of the transfer charge, with all other explosives, including the transfer charge, being secondary explosives. As discussed above, loading of secondary explosives into the very small volumes associated with the fixtures of MEMS S&A devices presents special problems. Similar problems are presented with respect to providing films and coatings for such devices.

In the latter regard, important applications of the explosive coating composition of the present invention are the preparation of explosive logic circuits, thick film coatings, self-destruct circuits, demolition devices, explosive initiation trains and multi-point explosive initiation systems, in addition to loading small volume and/or small diameter devices.

As is believed to be evident from the foregoing, in order to provide a MEMS safe and arm device that performs reliably, despite the small volume thereof, it is essential that the explosive coating or fill used have a high energetic output and a small critical thickness or diameter. One explosive material that meets both requirements is CL-20 (epsion HNIW), although as discussed below, a number of other materials, such as HMX, RDX, TNAZ, PETN, HNS and others, of the appropriate size can be used. Several of the energetic materials occur in crystalline polymorphs, and any of the polymorphs can be used in the preparation of the coatings. These other energetic materials are well known in the art, for example, TNAZ is 1,3,3-trinitroazetidine.

The solid fill particle size is 25 microns or less, with 5 microns being the optimal size. The solids can be prepared by crystallization or comminution of the raw material to give the required size. Particle comminution can be carried out using a ball mill, vibratory mill, fluid energy mill or the like.

In a method similar to that used in paint preparation, a ball mill is used in which the solid material, and a small volume of mobile phase/ancillary coating component, are added to the grinding media prior to milling. The resulting mill base is then used to prepare the coating composition in its final form.

In accordance with one embodiment of the invention, the energetic coating or fill material is prepared as a slurry, and a number of different liquids can be used as the mobile phase, which can be aqueous or organic in nature. In one preferred embodiment, organic liquids are used as the mobile phase and, more preferably, the organic liquid used is selected from the group consisting of ethanol, isopropanol, and a mixture of alcohol and ethyl acetate, although other organic liquids can be used. In this regard, CL-20 has a low solubility in the alcohols and high solubility in ethyl acetate and the solubility of the energetic coating or fill material can be controlled by adding alcohol to the slurry liquid. Again, it will be appreciated by those skilled in the art that a variety of different liquids can be used and the solubility of the explosive coating or fill can be tailored using different liquids in order to meet the needs of the actual system with which the energetic material is to be used.

The mobile medium for the coatings can be prepared from aqueous organic or aqueous/organic mixtures of polymeric binder systems, including, but not limited to polyvinyl alcohol, polyvinyl alcohol/polyvinyl ester copolymers, polyacrylates, casein, polyvinyl alcohol/polyvinyl pyrrolidone copolymers, polyvinyl pyrrolidone, substituted polyvinyl pyrrolidone, ethylene-vinyl alcohol/acetate terpolymers, polyurethanes, styrene-maleic anhydride copolymers, styrene-acrylic and epichlorohydrin-based copolymers. Energetic polymer systems that can be used include GAP, polyGLYN and oxetane-based polymers, such as, polyBAMO, AMMO, BAMO-AMMO copolymers, and polyNIMMO. The latter are well known energetic polymers and, for example, BAMO is 3,3-bis-azidomethyl-oxetane, while AMMO is 3-azidomethyl-3-methyloxetane, and the oxetane thermoplastic elastomer energetic binder is available from Thiokol Corporation.

The coating compositions are preferably prepared by portion-wise addition of the dry solid fill or mill base to a mixed solution or latex suspension of the binder system. Mixing is continued until all of the solids have been incorporated and a homogeneous solution is obtained. Materials incorporating 0.01-10 weight percent binder, with respect to the energetic solids fill. Materials with 90-96 weight percent energetic solids are preferred as coatings.

A plasticizer can be used along with the binder to improve the adhesive strength and flexibility of the dried energetic material. Further, ancillary components such as surfactants, thickeners, defoaming agents or the like can be incorporated to improve the rheological properties of the coatings.

Once the coating material is prepared, a number of different delivery methods or systems can be used to deliver the coating to the desired surface. The coating can be directly applied to prepared or unprepared surfaces of many different materials, including aluminum, stainless steel, silicon, glass, ceramic, plastic, wood, paper and the like.

In accordance with a delivery method in accordance with one important implementation of the invention, the coating of energetic material is delivered using a wiping technique, wherein the coating composition is taken up on a brush, roller or other wiping element and is wiped over the receiving surface. Referring to FIG. 1, a roller or wiping element is denoted 10 and a coating composition including an energetic material is indicated at 12. By wiping roller 10 over the surface of a substrate 14, the coating composition can be directly applied.

Figure 2:
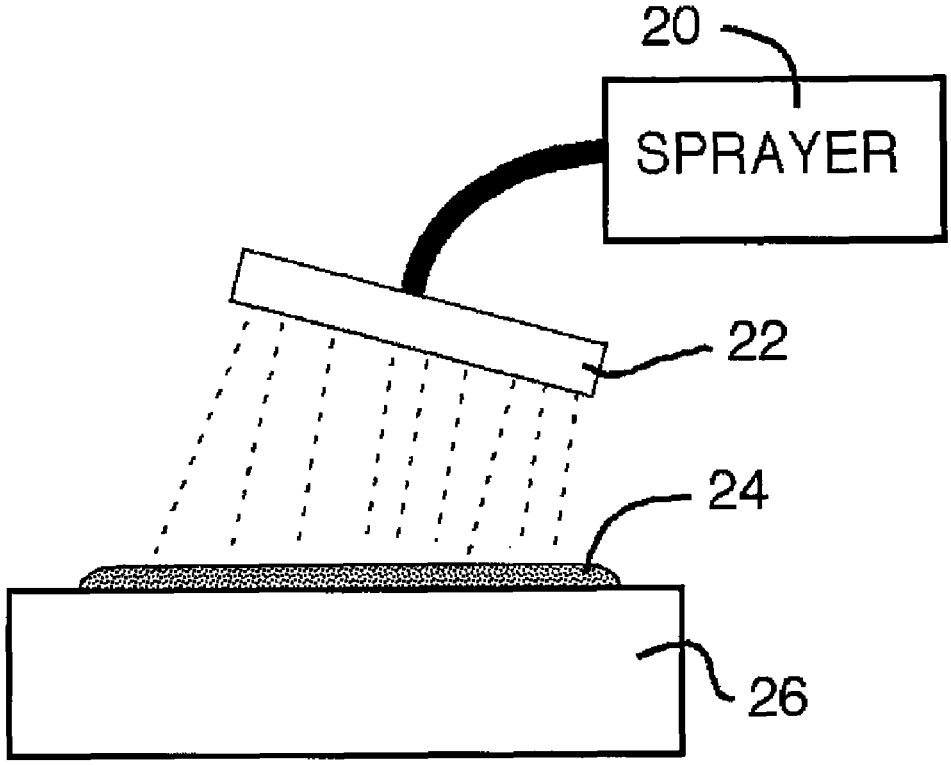
FIG. 2 is a schematic side elevation view of an energetic coating delivery system in accordance with a further embodiment of the invention.

A further delivery method is illustrated schematically in FIG. 2, wherein a sprayer device 20 including a spray head 22 is used to spray a coating 24 on substrate 26.

Figure 3:
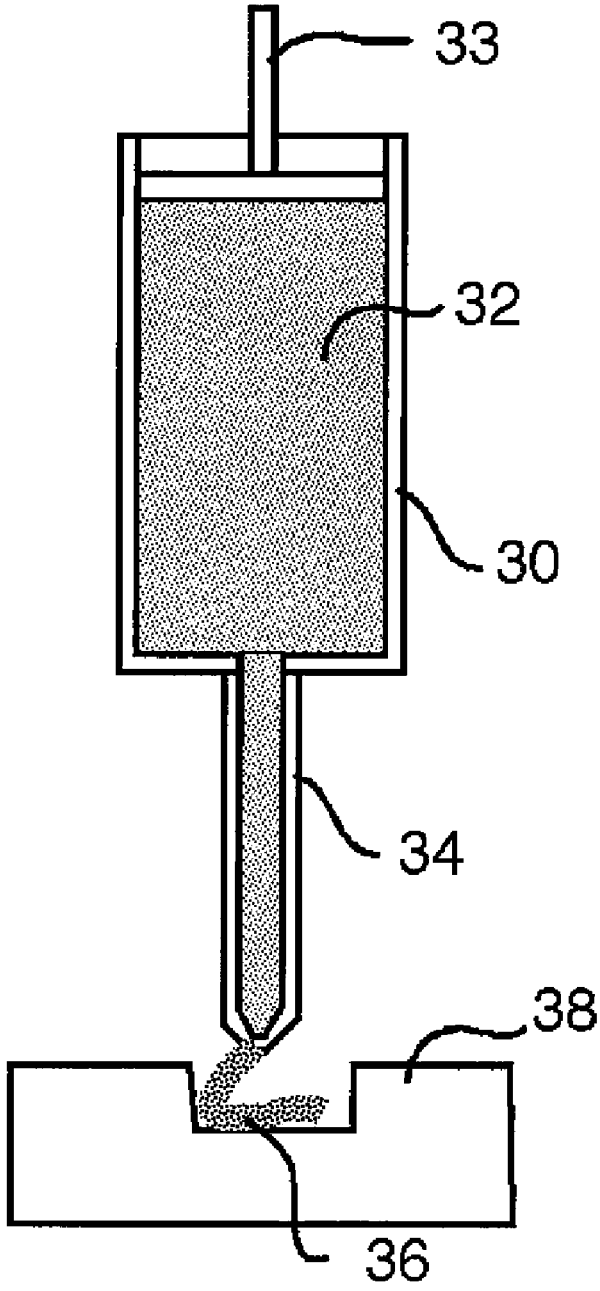
FIG. 3 is a schematic side elevation view, partially in section, of an energetic coating delivery system in accordance with another embodiment of the invention.
Figure 4:
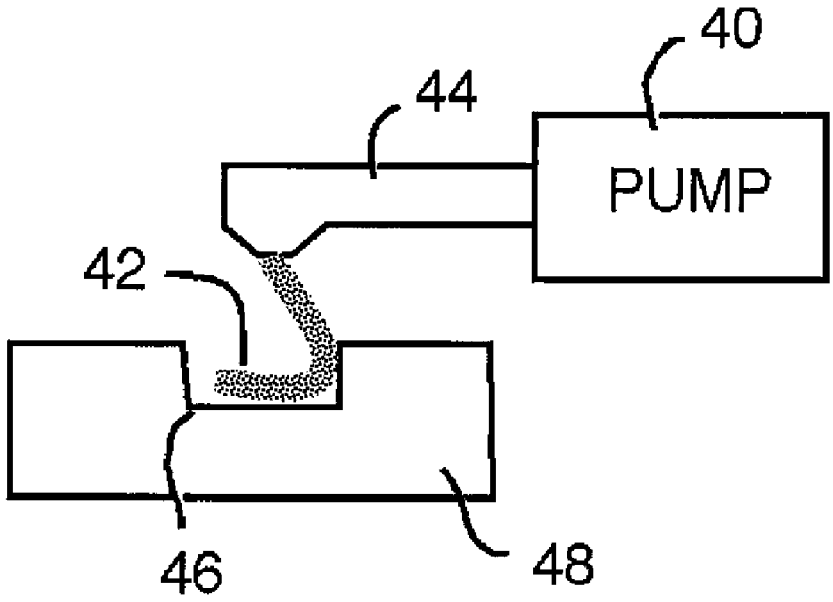
FIG. 4 is a schematic side elevation view of an energetic coating delivery system in accordance with yet another embodiment of the invention.

A delivery method in accordance with a further embodiment of the invention involves pressure loading of the energetic material, wherein, broadly speaking, the energetic material is placed into a container and forced through an orifice in the container for delivery. This method is illustrated in FIG. 3, which shows a container 30 that is filled with slurry or paste 32 of energetic material and that includes a plunger 33. Container 30 also includes an outlet orifice or opening 36. Depressing of plunger 33 causes the energetic material 32 to be expressed out of orifice 34 into, in this particular application, a loading hole 36 in a fixture indicated schematically at 38. It will be appreciated that a number of different pressure-loading devices can be used including, for example, pipettes, syringes, and various pumps, including peristaltic and positive-displacement pumps. The latter approach is illustrated schematically in FIG. 4, which shows a pump 40 for receiving energetic material 42 in paste or slurry form and for pumping the energetic material 42 through a delivery tube 44 into loading hole 46 in a fixture 48.

Figure 5:
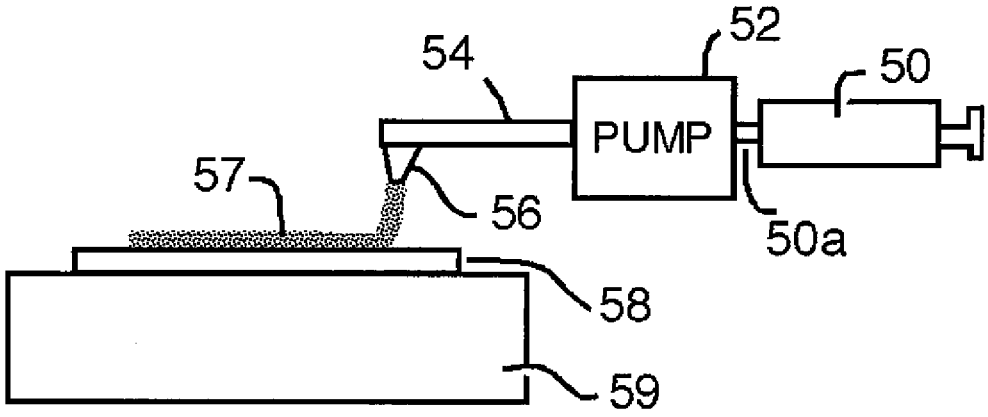
FIG. 5 is a schematic side elevation view of an energetic coating delivery system in accordance with a still further embodiment of the invention.

A further important embodiment is illustrated schematically in FIG. 5. In this embodiment, the energetic material is prepared as a slurry and loaded into a pressure delivery unit 52 which can be a syringe similar to that of FIG. 3, but could also be a piston device which a small exit orifice, an extruder or the like. The exit aperture 50*a* of unit 50 is connected to a positive displacement pump 52. The energetic material is pumped through a delivery tube 54 and exits through a writing tip 56 to form a coating 57 on a writing substrate (fixture) 58 disposed on a computer-controlled writing platen 59. The positioning of the fixture 58 under the writing tip 56, the coating pattern that is to be applied and the cavities to be filled are all determined by the computer-controlled platen 59 which is movable in the x- and y-directions. A commercial, off-the-shelf positive displacement pumping system that may be used for this purpose is the Micro-Pen™ writing system (Micro-Pen Division of Ohm Craft, Honeoye Falls, N.Y.). The system is CAD-controlled and "writes" specified patterns in pumpable fluids (pigment-, metal- or ceramic-based) on any surface.

Example 1

Sufficient water was added to a latex mixture of polyvinyl alcohol (0.5 grams) in water, resulting in a total volume of 5 mL of water. CL-20 (9.5 g) was added to the stirred latex mixture in 1-gram quantities. The mixture was blended until the solids were completely incorporated. This was repeated until all solids were mixed in.

Example 2

A coating composition, prepared as described in Example 1, was loaded into the barrel of a disposable syringe, and the syringe plunger added. A 20-gauge syringe needle, cut down to a 0.5-inch length, was fitted to the end of the syringe. The plunger was depressed, thereby ejecting the material. This method was used to write a pattern on an aluminum fixture. After the material had dried, a detonator was placed on an initiation point written using the coating. The detonator was functioned, thereby initiating a high order detonation in the explosive track.

Example 3

A coating composition, prepared as described in Example 1, was loaded into the barrel of a syringe, and the plunger added. The syringe was fixed to a pump block of a Micro-Pen™ positive displacement pumping system as described above. Pressure was applied to the plunger by the ram of the MicroPen™, and the coating was forced through the pen tip and a pattern was "written" on plastic surface.

Example 4

A coating composition, prepared as described in Example 1, was spread on the surface of an aluminum sheet, between two metal shims affixed to the aluminum sheet. A second aluminum sheet was added on the top of the coated sheet. The coating was allowed to dry. A detonator was affixed to the end of the fixture and functioned. The coating underwent a high order detonation.

In general, in use of the coating composition of the invention, upon initiation, the coating undergoes high order detonation. The coating detonates in an unconfined or confined state and the detonation undergo 90 degree, or greater, turns along rectilinear and curvilinear paths. As indicated above, the coating compositions of the invention have many applications and can, for example, be used to fill microliter detonation cavities, write explosive logic circuits and, when a thin coating of an explosive material is required, cover a large surface area.

It will also be appreciated that the explosive material can be placed in a flexible container, and applied to a substrate by squeezing the container mechanically or by hand.

Although the invention has been described above in relation to preferred embodiments thereof, it will be understood by those of skill in the art that variations and modifications can be effected in these preferred embodiments without departing from the scope and spirit of the invention.

We claim:

1. A method for applying a thick ink as an explosive logic circuit on a substrate, the method comprising the steps of:

selecting an crystalline energetic material;

selecting a small volume of mobile phase;

selecting a binder, 0.01 to 10 weight percent with respect to said crystalline energetic material;

mixing said mobile phase and binder phase to form a mixture;

adding to said mixture said crystalline energetic material;

comminuting said mixture containing said crystalline energetic material, until the particle size therein is no greater than 25 microns and the resulting mixture containing the crystalline energetic material is in the form of a thick film ink;

forcing said thick film ink through an orifice onto said substrate in a specified pattern, thereby writing said pattern on said substrate;

wherein said substrate is approximately one square centimeter or less in area and about 500-microns thick.

2. A method of applying a thick ink as an explosive logic circuit on a substrate, as claimed in claim 1, wherein said orifice is a writing tip and wherein said substrate is mounted on a computer-controlled platen, movable in the x- and y-directions, whereby said computer-controlled platen is moved creating said specified pattern.

3. A method of applying a thick ink as an explosive logic circuit on a substrate, as claimed in claim 1, wherein said mobile phase is selected from the group consisting of ethanol, isopropanol, a mixture of alcohol and ethyl acetate, and water.

4. A method of applying a thick ink as an explosive logic circuit on a substrate, as claimed in claim 1, wherein said binder phase is selected from the group consisting of polyvinyl alcohol, polyvinyl alcohol/polyvinyl ester copolymers, polyacrylates, casein, polyvinyl alcohol/polyvinyl pyrrolidone copolymers, polyvinyl pyrrolidone, substituted polyvinyl pyrrolidone, ethylene-vinyl alcohol/acetate terpolymers, polyurethanes, styrene-maleic anhydride copolymers, styrene-acrylic and epichlorohydrin-based copolymers, GAP, polyGLYN, polyBAMO-AMMO, BAMO-AMMO copolymers, polyNIMMO and aqueous mixtures thereof.

5. A method of applying a thick ink as an explosive logic circuit on a substrate, as claimed in claim 1, wherein said crystalline energetic material is selected from the group consisting of CL-20, HMX, RDX, TNAZ, PETN, and HNS.

6. A method of applying a thick ink as an explosive logic circuit on a substrate, as claimed in claim 1, wherein said thick ink is forced onto said substrate by filling a container with said thick ink, said container having a plunger and an orifice, wherein when said plunger is depressed, said thick ink is forced from said container, through said orifice to form a pattern on said substrate.

7. A method of applying a thick ink as an explosive logic circuit on a substrate, as claimed in claim 6, wherein said container, plunger and orifice are in the form of a syringe.

8. A method of applying a thick ink as an explosive logic circuit on a substrate, as claimed in claim 6, wherein said thick ink is forced by a positive displacement pumping system.

9. A method of applying a thick ink as an explosive logic circuit on a substrate, as claimed in claim 1, wherein said explosive logic circuit is a self destructive logic circuit.

10. A method of applying a thick ink as an explosive logic circuit on a substrate, as claimed in claim 1, wherein said explosive logic circuit provides an explosive initiation train on said substrate.

11. A method of applying a thick ink as an explosive logic circuit on a substrate, as claimed in claim 10, wherein said initiation train is part of a multi-point explosive initiation system.

12. A method of applying a thick ink as an explosive logic circuit on a substrate, as claimed in claim 1, wherein said substrate is part of a small volume loading hole and said explosive logic circuit is used to provide loading of said loading hole.

13. A method of applying a thick ink as an explosive logic circuit on a substrate, as claimed in claim 1, wherein said thick ink is prepared as a slurry in a mobile phase the is aqueous.

14. A method for applying a thick ink as an explosive logic circuit on a substrate, the method comprising the steps of:

selecting a dry solid fill or mill base energetic material, with a particle size no greater than 25 microns;

selecting a plasticizer;

selecting a mixed solution or latex suspension of a binder system, 0.01 to 10 weight percent with respect to said crystalline energetic material;

mixing said energetic material, said plasticizer and said binder system until all of the solids have been incorporated and a homogenous thick film ink is formed;

forcing said thick film ink through an orifice onto said substrate in a specified pattern, thereby writing said pattern on said substrate;

wherein said substrate is approximately one square centimeter or less in area and about 500-microns thick.

* * * * *